US005243505A

United States Patent [19]

Carr

[11] Patent Number: 5,243,505

[45] Date of Patent: Sep. 7, 1993

[54] SELECTIVELY ROTATABLE DROP LIGHT

[76] Inventor: Edwin Carr, Rte. #1, Box 320, Clayton, N.Y. 13624

[21] Appl. No.: 959,367

[22] Filed: Oct. 13, 1992

[51] Int. Cl.[5] ..... F21V 21/28

[52] U.S. Cl. ..... 362/275; 362/285; 362/368; 362/376; 362/396; 362/378

[58] Field of Search ..... 362/396, 378, 376, 363, 362/368, 285, 427, 421, 398, 344, 353, 399, 275, 269

[56] References Cited

U.S. PATENT DOCUMENTS

| | | | |
|---|---|---|---|
| 1,692,892 | 11/1928 | Floyd | 362/378 |
| 2,460,173 | 1/1949 | Halbing | 362/376 |
| 2,510,708 | 6/1950 | Marshall | 362/378 |
| 2,694,776 | 11/1954 | Wittman | 362/378 |
| 2,745,000 | 5/1956 | Kowalcyk | 362/378 |
| 4,581,688 | 4/1986 | Trygar | 362/368 |
| 4,594,647 | 6/1986 | Dippert | 362/376 |
| 5,163,751 | 11/1992 | Bottiglieri | 362/376 |

*Primary Examiner*—James C. Yeung
*Attorney, Agent, or Firm*—Katherine McGuire

[57] ABSTRACT

A rotatable drop light assembly comprises three alternate embodiments which may be retro-fitted to different types of conventional drop light apparatus for selectively directing the light about a full 360° radius while suspended from an anchor point. A first embodiment comprises a circular plate rotatably mounted to and spring biased toward the top wall of the light reflector/-shield, with both including annularly spaced, raised protrusions which go into and out of aligned engagement upon rotating the housing with respect to the anchoring hook. In a second embodiment, a flanged bushing lockingly engages a non-circular aperture in a rotatable plate with the anchoring hook fixed to the bushing. In a third embodiment, a first plate is rotatably mounted to a second plate which is attached to and extends from the top edge of the light shield/reflector.

3 Claims, 3 Drawing Sheets

SELECTIVELY ROTATABLE DROP LIGHT

BACKGROUND OF THE INVENTION

The invention broadly relates to drop lights, and more particularly, to new and improved drop light apparatus allowing selective rotation of the drop light housing with respect to its anchor point when the drop light is suspended from a fixed overhead anchor point.

Drop lights are utilized to provide illumination in areas where conventional overhead lighting is unavailable, e.g., under the hood of a car. A typical drop light comprises a generally cylindrical housing having a hook extending from one end thereof adapted to suspend the drop light from a convenient overhead structure. The drop light housing comprises an opaque light shield/reflector in combination with a caged open front wherethrough a light bulb positioned in the center of the housing emits light. Absent means to rotate the housing about the hook, the drop light must be removed and re-suspended at a different angle each time the user desires the direction of light emission to change.

Rotatably adjustable drop light assemblies are known in the prior art. U.S. Pat. No. 4,298,922, issued to Hardwick on Nov. 3, 1981, discloses a somewhat overly complicated mechanism using spring biased detent balls to achieve selective rotary motion of the drop light housing relative to the suspension hook. U.S. Pat. No. 4,305,120, issued to Lacinski on Dec. 8, 1981, discloses a housing provided with an annular ring extending from and spaced above the top surface of the housing, the ring having a plurality of uniformly spaced, radially extending serrations on the bottom surface thereof facing the housing. An adapter which depends from an anchoring hook has a corresponding plurality of radially extending serrations on a top surface thereof and is positioned about the housing annular ring such that the serrations on each ring engage each other when the light is suspended from an anchor point. To rotate the housing with respect to the adapter and anchor point, the adapter and the housing are manually moved toward each other by lifting the suspended housing which disengages the rings. Upon release, the rings re-engage at the desired rotational angle. U.S. Pat. Nos. 4,321,660 to Sakol; 3,755,668 to Moreschini; 4,581,688 to Trygar; and 4,369,487 to Carlow; disclose yet further types of rotational drop light assemblies.

The above cited references employ overly complicated structures to achieve selective rotation of the light shield relative to the anchor point which would seemingly be costly to manufacture.

It is therefore a principal object of the present invention to provide a rotatably adjustable drop light which is extremely simple and quick to operate.

It is another object of the present invention to provide a rotatably adjustable drop light which is simple in construction and has a minimum of parts, and which is otherwise economically attractive.

It is yet another object of the present invention to provide apparatus for the selective rotation of a drop light housing about a fixed anchor point which apparatus may be easily retro-fitted to existing drop light assemblies.

Other objects will in part be obvious and in part appear hereinafter.

SUMMARY OF THE INVENTION

In accordance with the foregoing objects, a drop light assembly is provided including means for selectively rotating the housing including the light shield/reflector portion thereof about an anchor point from which the assembly is suspended. The light emitted from a bulb positioned within the drop light housing may therefore be selectively directed about a full 360° radius without having to remove the drop light housing from the anchor point.

In a first embodiment of the present invention, a drop light housing includes a light shield/reflector with a top wall having a plurality of annularly spaced protrusions formed therein. A substantially circular, rigid plate also includes a corresponding plurality of annularly spaced protrusions formed therein and is positioned in covering relation over the light shield/reflector top wall with the protrusions on each the top wall and plate in aligned engagement. First and second, axially aligned apertures are centrally formed through the shield/reflector top wall and plate, respectively. The threaded shaft of a hook extends through the apertures with only the plate being fixedly attached to the hook. A spring is disposed about the lower portion of the hook shaft which extends within the cavity of the housing and is held therearound in a slightly compressed position by a nut threaded onto the terminal end of the hook shaft. The spring thus biases the top wall of the light shield/reflector against the rotatably mounted plate. The housing of the suspended drop light may be rotated relative to the stationary hook and plate by rotating the housing to the desired position. When the light is thus being emitted in a desired direction, the housing may be released whereby the spring biases the top wall into frictional engagement with the plate. This embodiment allows the drop light housing to be selectively rotated a minimum of the distance between two adjacent protrusions and a maximum of 360°.

In a second embodiment of the present invention, a circular plate is rotatably mounted in covering relation to the outer surface of the top end cap of an elongated, fluorescent drop light assembly. The plate includes a substantially centrally positioned, non-circular aperture formed therethrough. The end of a cooperatively shaped, flanged bushing having a longitudinally extending aperture extends into and lockingly engages the aperture formed in the plate. The apertures in the flanged bushing and plate axially align with an aperture formed in the top wall of the end cap through each of which extends the shaft of an anchoring hook. The head portion of the bushing is threaded upon and moves with the hook shaft. A spring is disposed around the bushing shank which biases the rotatably mounted plate against the top wall of the housing end cap. A nut is threaded onto the terminal end of the hook which extends into the housing thereby allowing rotation of the housing relative to the hook and plate.

In yet a third embodiment of the present invention, a first circular plate is fixedly mounted to a top portion of the light shield/reflector with the center of the plate having an aperture formed therein extending over the edge of the light shield/reflector and positioned directly above the light bulb. A second circular plate having a central, threaded aperture is aligned in covering relation to the aperture in the first plate. The shaft of a hook is threadedly engaged through the aperture in the second plate and freely extends through the aligned aperture in the first plate. A spring is disposed about the portion of the shaft extending into the housing with a nut secured to the end thereof effectively biasing the first and second plates towards each other. The manner of rotating the housing with respect to the hook is the same as with the first and second embodiments summarized above.

DETAILED DESCRIPTION

Figure 1:
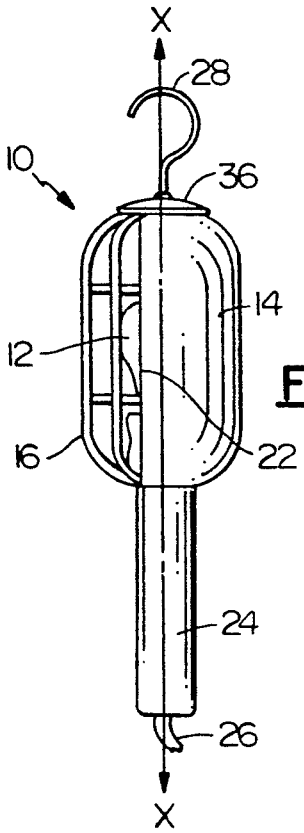
FIG. 1 is a side elevational view of a first embodiment of the present invention retro-fitted to the top wall of the light shield/reflector of a conventional drop light assembly.
Figure 2:
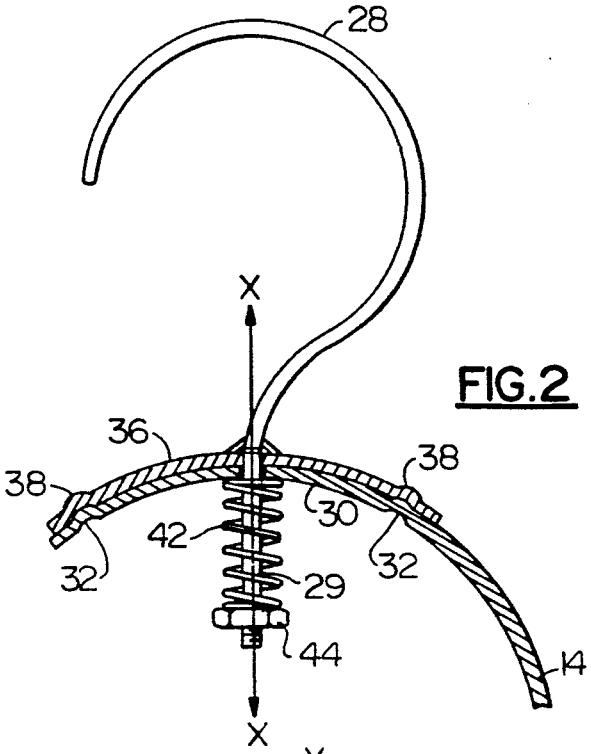
FIG. 2 is an enlarged, cross-sectional view through the center of the top portion of the invention seen in FIG. 1.
Figure 4:
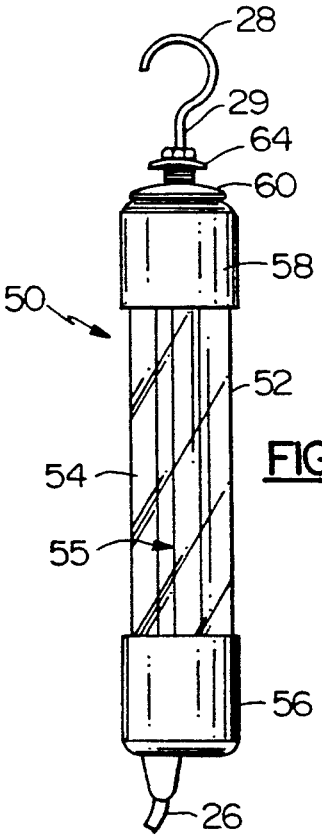
FIG. 4 is a side elevational view of a second embodiment of the present invention retro-fitted to the top end cap of another conventional fluorescent drop light assembly.
Figure 3:
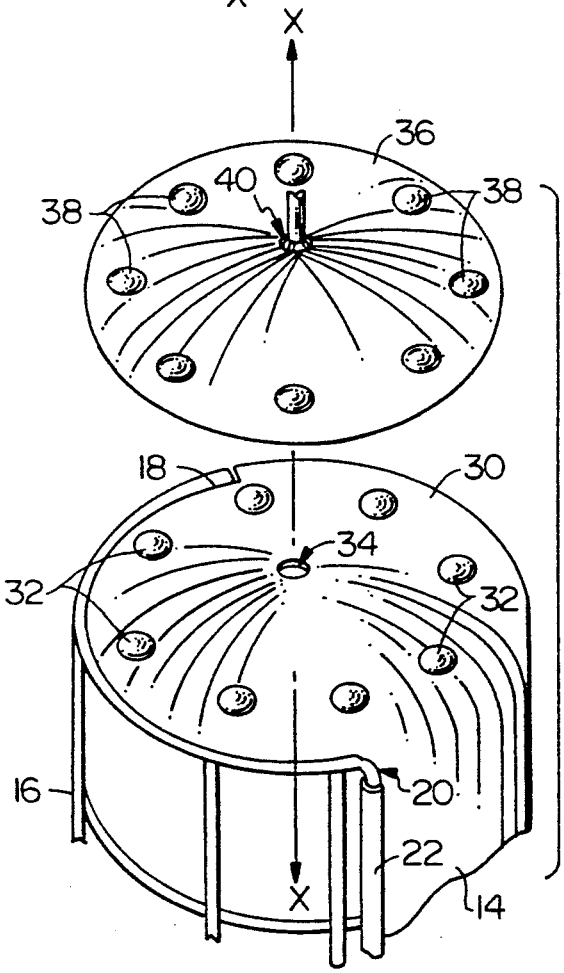
FIG. 3 is a perspective view of the embodiment seen in FIGS. 1 and 2 showing the upper plate spaced above the light shield/reflector top wall.

Referring now to the drawings wherein like reference numerals reference like parts throughout the ensuing specification, there is seen in FIGS. 1–3 a first embodiment of the invention retrofitted to a first type of prior art drop light assembly denoted generally by the reference numeral 10. Drop light assembly 10 includes a light bulb 12 operably positioned within a housing having a concave light shield/reflector 14 and a concave front cage 16 together forming longitudinal halves of a generally cylindrical housing. Cage 16 is hingedly connected along edge 18 thereof to the adjacent edge of light shield/reflector 14 with opposite edge 20 removably engaging lipped edge 22 of light shield/reflector 14. As such, cage 16 is movable between open and engaged positions with respect to light shield/reflector 14 in the usual operation of drop light assemblies so that the interior of the housing is accessible for removal and replacement of bulb 12 as is necessary.

As seen in FIG. 1, the housing is mounted to a handle 24 through which an electric cord 26 extends supplying electricity to bulb 12. A hook 28 extends from the top wall of light shield/reflector 14 for suspending assembly 10 from an overhead anchor point. The description thus far has described a drop light assembly having the above described structural features typically found on many prior art drop light assemblies. Attention is now turned to the first embodiment of the invention which, as previously mentioned, is retro-fitted to the prior art drop light assembly 10 in the manner described below to permit selective rotation of the light housing with respect to hook 28 and thus the over-head anchor point.

As seen best in FIGS. 2 and 3, prior art light shield/reflector 14 includes a top wall 30 integrally formed therewith and being generally circular and outwardly slightly convex in shape. A first plurality of annularly spaced, circular protrusions 32 are formed in top wall 30 with each protrusion 32 being substantially equally spaced from each other and a centrally located aperture 34 which lies along longitudinal axis x—x extending through bulb 12 and handle 24. A circular, dome-shaped plate 36 includes a second plurality of annularly spaced, circular protrusions 38 and a central aperture 40 which align with protrusions 32 and aperture 34, respectively, when plate 36 is placed in contacting, covering relation to top wall 30 as seen best in FIG. 2.

The shank 29 of hook 28 extends through aligned apertures 34 and 40 with shank 29 being fixedly secured to aperture 40 of plate 36 by welding or other known method of fusibly joining metals. While shank 29 is fixedly secured to plate 36, shank 29 extends freely through, and is hence independently movable with respect to, aperture 34 in top wall 30 of light shield/reflector 14. As seen in FIG. 2, a spring 42 is disposed around threaded shank 29 with a securing nut 44 threaded onto the terminal end thereof maintaining spring 42 at a predetermined and slightly compressed position which is less than the fully compressed position of spring 42 (not shown). Thus, with shank 29 fixed to plate 36, spring 42 biases plate 36 and top wall 30 together.

Referring now to the manner of working the first embodiment of the invention just described, hook 28 is secured to an over-head anchor point (not shown) which suspends drop light assembly 10 therefrom in the usual manner of using a drop light assembly. Since most available anchor points do not permit rotation of hook 28 with respect thereto, the present invention provides means by which the light housing may be rotated with respect to hook 28. As mentioned previously, this rotational freedom of the light housing is desirable since it permits cage 16 and thus the light being emitted therefrom to be selectively directed about a 360° radius with respect to the work site as desired.

With hook 28 fixed to the anchor point, the user manually grasps handle 24 and rotates the light housing with a force slightly greater than the biasing force of spring 42. With the biasing force of spring 42 overcome, the coefficient of friction between plate 36 and top wall 30 is reduced to the point where they may rotate independently of each other. The user manually rotates handle 24 which rotates the light housing including top wall 30 while hook 28 and plate 36 remain stationary. When the desired direction has been reached, handle 24 is released causing spring 42 to bias top wall 30 and plate 36 together.

It will be appreciated that as top wall 30 rotates with respect to plate 36, the first plurality of protrusions 32 repeatedly move in and out of alignment with the second plurality of protrusions 38, respectively, through a full 360° rotation thereof. When in alignment, each pair of protrusions 32 and 38 provide a detent tending to secure plate 36 in its positional relationship with top wall 30 when spring 42 is in the semi-compressed position of FIG. 2. Since there are eight pairs of protrusions 32 and 38, plate 36 may be rotated between eight secured positions each 60° apart from an adjacent pair. Although eight pairs of protrusions are shown and described herein for purposes of illustration, it is intended that any number of pairs of protrusions would work just as well. Also, although desirable, it is not critical that the protrusions be equally spaced from each other as shown in FIG. 3. It will also be obvious to those skilled in the art that protrusions 32, 38 may protrude either toward (not shown), or away (shown) from bulb 12.

Attention is now turned to a second embodiment of the invention as seen in FIGS. 4–7. The second embodiment is retrofitted to a conventional elongated fluorescent drop light assembly 50 having a convex and opaque light shield/reflector 52 and transparent front window 54 together forming a cylindrical housing in which an elongated fluorescent light tube 55 is positioned for operation. Bottom and top end caps 56 and 58, respectively, are secured to the housing with at least end cap 58 being removable to permit removal and replacement of light tube 55 as necessary. Electric cord 26 extends through an aperture in bottom end cap 56 to connect and supply electricity to light tube 55 in the housing.

Figure 6:
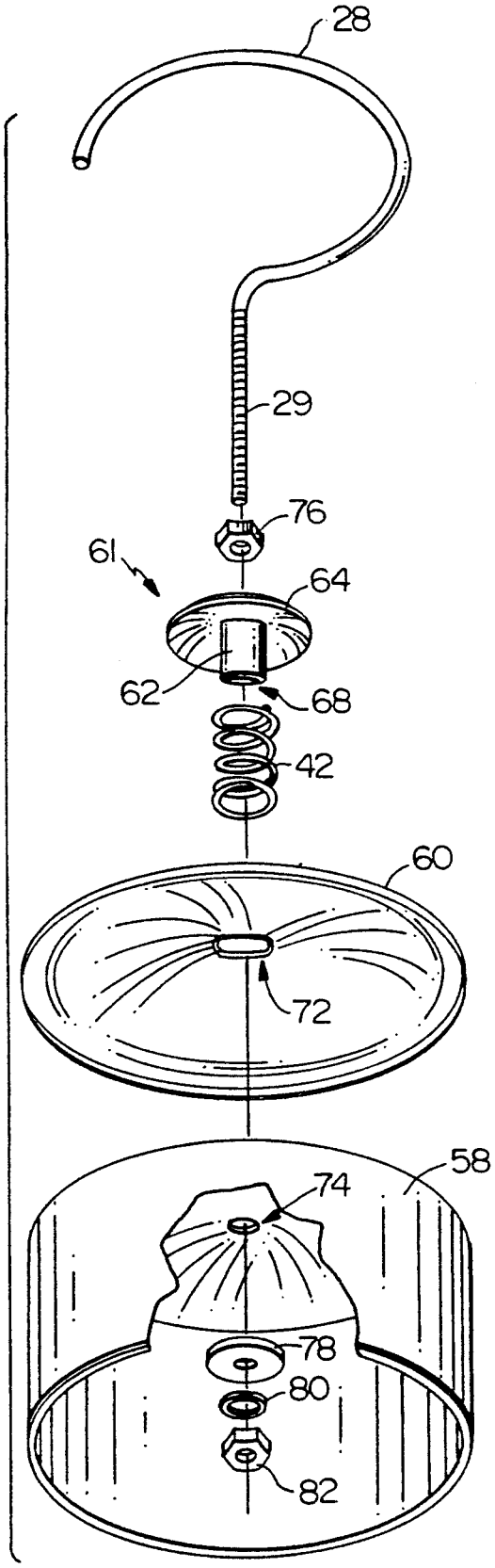
FIG. 6 is an exploded, perspective view of FIG. 5.
Figure 5:
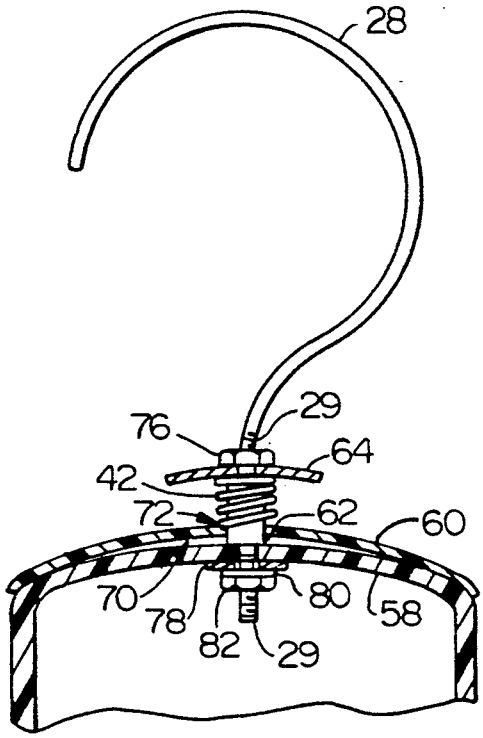
FIG. 5 is an enlarged, cross-sectional view through the center of the top portion of the invention seen in FIG. 4.
Figure 7:
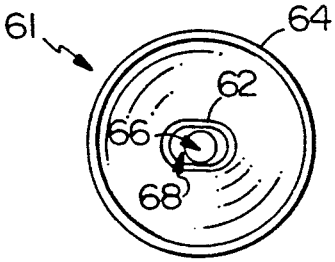
FIG. 7 is a plan view of the flanged bushing element seen in FIGS. 5 and 6.

As seen best in FIGS. 5 and 6, the second embodiment of the invention is mounted to top end cap 58 and generally comprises a circular, domed-shaped plate 60 and flanged bushing 61 having an oval shank 62 extending from a domed head portion 64. Referring to FIG. 7, the flanged bushing includes a longitudinal hole extending from a circular aperture 66 in head portion 64, to an oval aperture 68 in shank 62.

Referring again to FIG. 5, plate 60 is positioned in covering relation over end cap 58 with the peripheries of each in contacting engagement and the center portion of plate 60 being slightly raised from end cap 58 forming a space 70 therebetween. Plate 60 is seen to include a centrally located, oval aperture 72 which aligns with centrally located, circular aperture 74 in end cap 58 when the former is placed in covering relation to the latter in the manner shown. Oval shank 62 of flanged bushing 61 is of slightly smaller length and width than oval aperture 72 in plate 60 whereby the end of shank 62 may be inserted through aperture 72 and abut end cap 58 with flanged bushing hole 68 aligning with apertures 72 and 74 in plate 60 and end cap 58, respectively.

Circular aperture 66 in head portion 64 of the flanged bushing is threaded and threaded shank 29 of hook 28 is threadedly engaged therewith with the terminal end of shank 29 extending exteriorly through bushing oval shank 62. Head portion 64 is fixed in position upon hook shank 29 by a securing nut 76 mounted in abutting engagement therewith.

In the fully assembled condition of the invention seen in FIG. 5, shank 29 extends through aperture 74 in end cap 58 and is secured thereto via a threaded disc 78, washer 80, and securing nut 82. A spring 42 is positioned about bushing shank 62 and is compressed between head portion 64 and plate 60 biasing plate 60 against end cap 58.

It may be appreciated from the foregoing that the drop light housing which includes end cap 50 may rotate with respect to plate 60 and hook 28 since hook shank 29 is fixed to bushing head portion 64, and bushing oval shank 62 is lockingly engaged within oval aperture 72 in plate 60. Following suspension of hook 28 to an overhead anchor point, the drop light housing of assembly 50 may be rotated with respect thereto by manually grasping and turning end cap 58 with a force sufficient to overcome the biasing force of spring 42. As such, window 54 and the light emanating therefrom may be selectively directed about a full 360° radius as desired.

Figure 8:
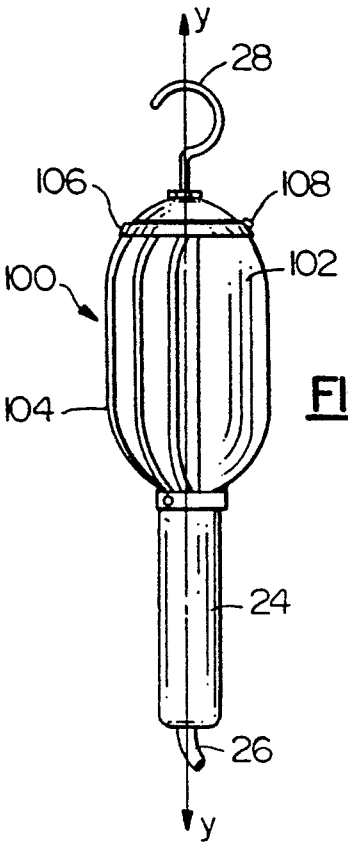
FIG. 8 is a side elevational view of a third embodiment of the present invention retro-fitted to yet another type of conventional drop light assembly.
Figure 9:
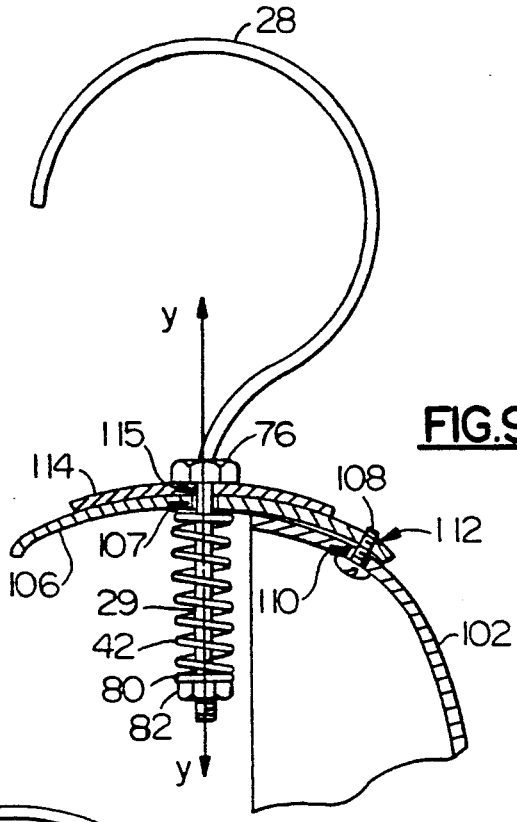
FIG. 9 is a cross-sectional view through the center of the top portion of the invention seen in FIG. 8.
Figure 10:
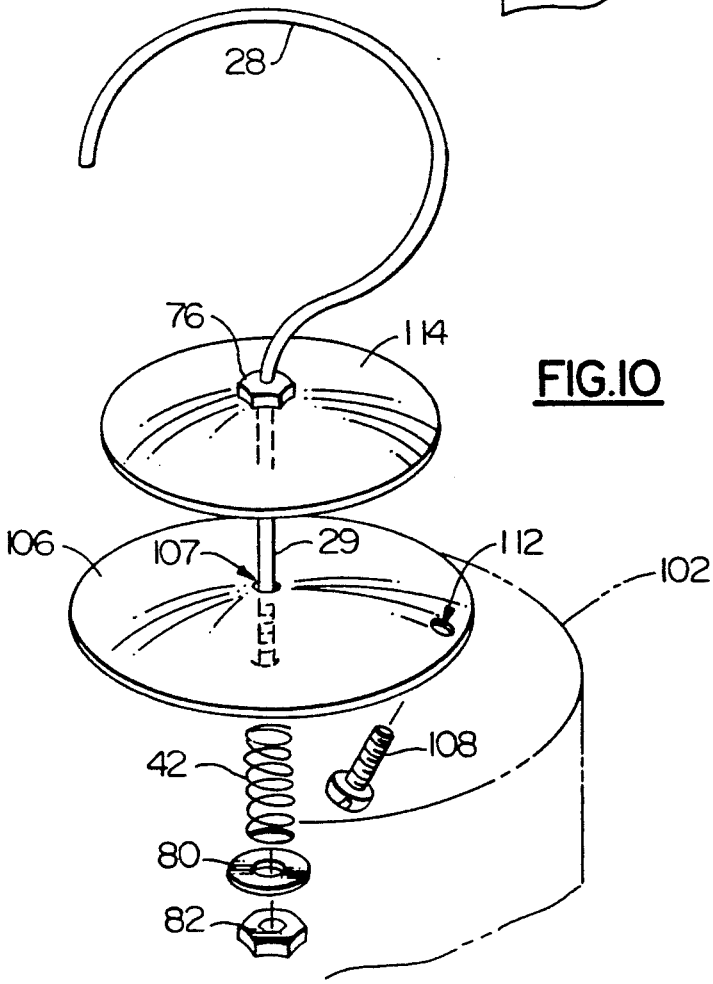
FIG. 10 is an exploded, perspective view of FIG. 9.

Referring lastly to a third embodiment of the invention, attention is turned to FIGS. 8–10 which show the third embodiment invention retro-fitted to a yet further type of conventional drop light assembly 100. Assembly 100 comprises the typical light shield/reflector 102 and front cage 104 together forming a cylindrical housing in which a light bulb (not shown) is positioned for operation, the bulb being supplied electric current by cord 26 extending through handle 24. Assembly 100 is thus seen to be very similar to assembly 10 with respect to which the first embodiment of the invention was described above, the difference being that light shield/reflector 102 does not include an integrally formed top wall such as top wall 30 seen in FIGS. 1–3.

A first domed plate 106 is fixedly attached in partial covering relation to light shield/reflector 102 via threaded bolt 108 passing through aligned apertures 110 and 112 in light shield 102 and plate 106, respectively. More than half the diameter of plate 106 rigidly extends from shield 102 with centrally located aperture 107 of plate 106 lying along longitudinal axis y—y of assembly 100. A second domed plate 114 having a diameter smaller than plate 106 is placed in covering relation thereto with bolt 108 lying outward of the periphery of plate 114 as seen in the fully assembled condition of FIG. 9. The shank 29 of hook 28 extends through and threadedly engages a central aperture 115 formed in plate 114 with a securing nut 76 maintaining plate 114 in a fixed position upon shank 29. Aperture 115 aligns with aperture 107 in plate 106 with shank 29 extending freely therethrough since the diameter of aperture 107 is larger than the maximum thread diameter on shank 29.

A spring 42 is disposed upon the portion of shank 29 extending within the housing of light assembly 100 and is maintained in a slightly compressed position thereon by washer 80 and securing nut 82. The end of spring 42 opposite nut 82 abuts plate 106 biasing plates 106 and 114 together. With hook 28 suspending assembly 100 from an over-head anchor point, the housing thereof including handle 24, shield 102, cage 104 and plate 106 may thus be rotated about axis y—y relative to hook 28 by manually grasping and turning handle 24 with a force sufficient to overcome the biasing force of spring 42 and reduce the coefficient of friction between plates 104 and 106.

What is claimed is:

1. A rotatable drop light assembly comprising:

a) a drop light housing including an electrically operable light source and an opaque light shield/reflector of predetermined configuration positioned in fixed relation and adjacent to said light source, said light shield/reflector including a top wall having a centrally positioned aperture formed therethrough;

b) a plate positioned in contacting, covering relation on a first surface of said light shield/reflector top wall facing in a direction away from said light source, said plate including a centrally positioned, non-circular aperture formed therethrough and in axial alignment with said light shield/reflector top wall aperture;

c) a flanged bushing having flanged head portion and elongated, non-circular shank portion integrally extending therefrom, said flanged bushing having a bore hole longitudinally and continguously extending from a circular opening in said flanged head portion to a non-circular opening in said non-circular shank portion, the end of said non-circular shank portion opposite said head portion inserted into and freely extending through said non-circular aperture in said plate with said shank portion end abutting said first surface of said light shield/reflector top wall, said non-circular shank portion and said non-circular aperture in said plate being of substantially the same shape with said non-circular shank portion rotatably lockingly engaging said non-circular aperture in said plate and said plate being slidingly and axially movable along said non-circular shank portion;

d) a rigid hook having an elongated, threaded shank extending entirely axially through and fixedly connected to said flanged bushing, and freely extending through said aperture in said light shield/reflector top wall where said light shield/reflector is axially slidingly movable upon said hook shank, said hook including a curved portion extending from said threaded shank in a direction away from said drop light housing, said curved portion configured to suspend said drop light housing from a fixed anchor point; and e) means biasing said plate and said light shield/reflector top wall together.

2. The invention according to claim 1 wherein said circular aperture in said flanged bushing head portion is threadedly engaged to said hook shank and further including a helical spring positioned about said flanged bushing shank portion, said spring extending between and abutting said flanged bushing head portion at a first end thereof, and said plate at a second end thereof.

3. The invention according to claim 2 and further including first and second nuts threaded upon said hook shank adjacent and abutting said flanged bushing head portion and a second surface of said light shield/reflector opposite said first surface, respectively.

* * * * *